US010300329B2

(12) United States Patent
Byrd

(10) Patent No.: US 10,300,329 B2
(45) Date of Patent: May 28, 2019

(54) RESILIENT EXERCISE ARTICLE

(71) Applicant: Tracy Byrd, Watkinsville, GA (US)

(72) Inventor: Tracy Byrd, Watkinsville, GA (US)

( * ) Notice: Subject to any disclaimer, the term of this patent is extended or adjusted under 35 U.S.C. 154(b) by 64 days.

(21) Appl. No.: 15/353,691

(22) Filed: Nov. 16, 2016

(65) Prior Publication Data

US 2017/0136282 A1 May 18, 2017

Related U.S. Application Data

(60) Provisional application No. 62/255,577, filed on Nov. 16, 2015.

(51) Int. Cl.

| | |
|---|---|
| ***A63B 21/00*** | (2006.01) |
| ***A63B 21/06*** | (2006.01) |
| ***A63B 41/00*** | (2006.01) |
| ***A63B 43/00*** | (2006.01) |
| *A63B 21/055* | (2006.01) |
| *A63B 71/02* | (2006.01) |

(52) U.S. Cl.

CPC .... *A63B 21/4035* (2015.10); *A63B 21/00043* (2013.01); *A63B 21/0607* (2013.01); *A63B 41/00* (2013.01); *A63B 43/007* (2013.01); *A63B 21/0552* (2013.01); *A63B 2071/027* (2013.01); *A63B 2225/62* (2013.01)

(58) Field of Classification Search

CPC ..... A63B 21/0557; A63B 21/4035; A63B 21/00043; A63B 41/00; A63B 21/0607; A63B 43/007; A63B 2225/62; A63B 2071/027; A63B 21/0552

See application file for complete search history.

(56) References Cited

U.S. PATENT DOCUMENTS

| | | | | |
|---|---|---|---|---|
| 4,733,862 | A | 3/1988 | Miller | |
| 5,242,348 | A | 9/1993 | Bates | |
| 5,810,700 | A | 9/1998 | Orcutt | |
| 5,833,587 | A | 11/1998 | Strong et al. | |
| 6,354,970 | B1 | 3/2002 | Reinke et al. | |
| 6,547,703 | B1 | 4/2003 | Swezey et al. | |
| 6,575,885 | B1 | 6/2003 | Weck et al. | |
| 6,652,421 | B1 | 11/2003 | Chen | |
| 6,837,835 | B2 | 1/2005 | Huang | |
| 6,837,836 | B2 * | 1/2005 | Huang | A63B 21/0552 482/122 |
| D503,756 | S | 4/2005 | Chiang | |
| D521,084 | S | 5/2006 | Huang | |
| 7,141,011 | B2 | 11/2006 | Williams et al. | |
| 7,285,080 | B1 * | 10/2007 | Chiu | A63B 21/0004 482/142 |
| 7,344,487 | B2 | 3/2008 | Carter et al. | |
| 7,942,796 | B2 | 5/2011 | Signorile et al. | |
| 7,993,250 | B2 * | 8/2011 | Abbott | A63B 22/203 482/126 |
| 9,168,411 | B2 * | 10/2015 | Holman | A63B 21/028 |
| 9,616,272 | B1 * | 4/2017 | Bennett | A63B 21/075 |

(Continued)

*Primary Examiner* — Megan Anderson

(74) *Attorney, Agent, or Firm* — Clements Bernard Walker PLLC; Christopher L. Bernard; Richard A. Walker

(57) ABSTRACT

A resilient exercise article includes an outer surface defining an interior chamber. The article comprises outward being one of a spherical shape, an ovoid shape or a double ovoid shape, at least one circumferential groove defined in the outer surface, and a bore extending axially through the article.

6 Claims, 5 Drawing Sheets

(56) References Cited

U.S. PATENT DOCUMENTS

| | | | | |
|---|---|---|---|---|
| 2003/0224914 | A1* | 12/2003 | De Montesquieux | A63B 21/0552<br>482/148 |
| 2004/0180768 | A1 | 9/2004 | Almada | |
| 2005/0143234 | A1 | 6/2005 | Massey | |
| 2010/0267526 | A1 | 10/2010 | Baschnagel | |
| 2011/0143896 | A1 | 6/2011 | Senegal | |
| 2011/0183827 | A1 | 7/2011 | Radi | |
| 2012/0115692 | A1* | 5/2012 | Bussen | A63B 21/0442<br>482/130 |

* cited by examiner

RESILIENT EXERCISE ARTICLE

CROSS-REFERENCE TO RELATED APPLICATIONS

This application claims priority to U.S. provisional application No. 62/255,577 filed Nov. 16, 2015.

BRIEF DESCRIPTION OF THE DRAWINGS

The apparatus is described with reference to the accompanying drawings. In the drawings, like reference numbers indicate identical or functionally similar elements.

DETAILED DESCRIPTION

Figure 1:
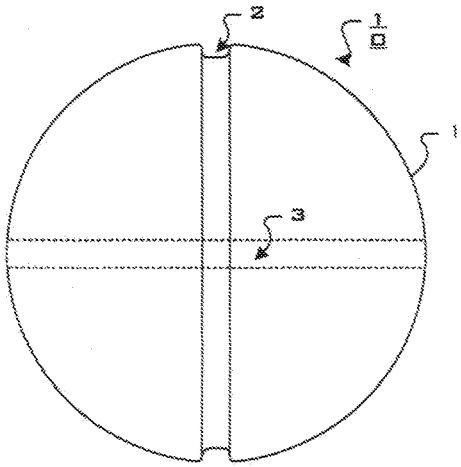
FIG. 1 is an elevation view of an exemplary exercise article.
Figure 2:
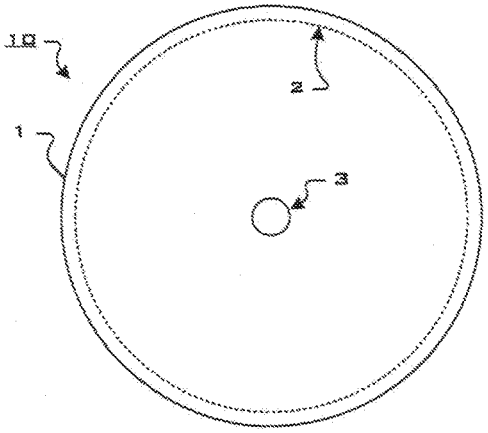
FIG. 2 is another elevation view of the exercise article of FIG. 1 rotated 90° in the horizontal plane.
Figure 3:
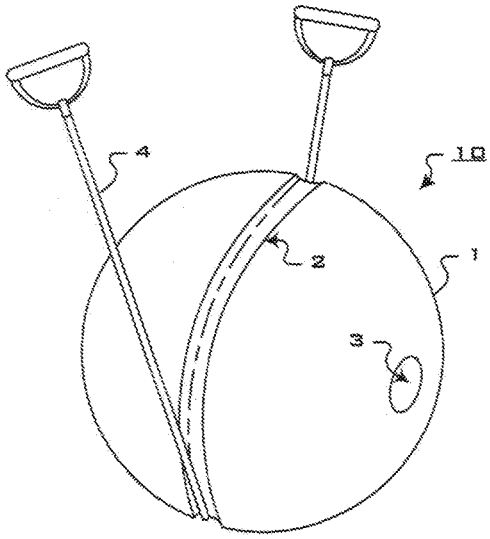
FIG. 3 is a perspective view of the exercise article of FIG. 1 with an elastic band situated in the channel thereof.
Figure 4:
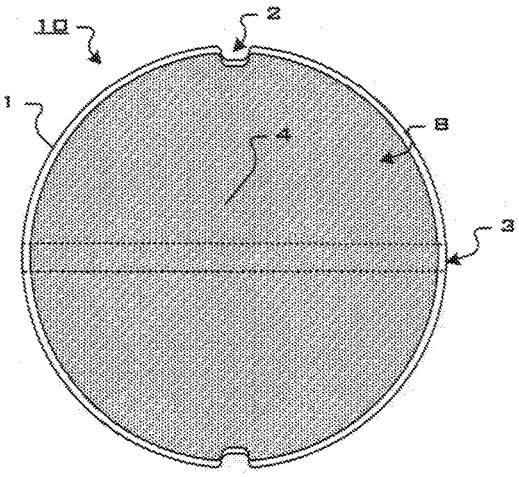
FIG. 4 is a sectional view of the article of FIG. 1.

The various embodiments of the exercise ball and their advantages are best understood by referring to FIGS. 1 through 13 of the drawings. The elements of the drawings are not necessarily to scale, emphasis instead being placed upon clearly illustrating the novel features and principles of operation. Throughout the drawings, like numerals are used for like and corresponding parts of the various drawings.

Furthermore, reference in the specification to "an embodiment," "one embodiment," "various embodiments," or any variant thereof means that a particular feature or aspect described in conjunction with the particular embodiment is included in at least one embodiment. Thus, the appearance of the phrases "in one embodiment," "in another embodiment," or variations thereof in various places throughout the specification are not necessarily all referring to its respective embodiment.

A first exemplary embodiment of a resilient exercise article 10 comprises a hollow spherical member 1 having a circumferential groove or channel 2 defined in the surface thereof disposed about the equator of the sphere 1. In one embodiment, the ball 10 also comprises an axial bore 3 defined through the spherical member 1. In such an embodiment, the axial bore 3 is oriented perpendicularly to the plane on which the channel 2 lies such that the axis of the axial bore 3 is the axis about which the circumferential channel 2 is defined.

The channel 2 should have a depth with respect to the outer surface of the spherical member 1 such that it can accommodate a length of exercise band 4, e.g., an elastic member having a handle attached to either end thereof. The channel 2 may also be used to accommodate a strap. In an embodiment in which the ball 10 comprises the axial bore 3, a length of exercise band 4 or a strap may be inserted through the axial bore 3.

The exercise article 10 may be inflatable, the article comprising an outer surface within which is defined an interior chamber 8. Additionally, the article 10 may be filled with a material 4 such as polystyrene foam to prevent rapid deflation should the surface of the article suffer a puncture.

Figure 5:
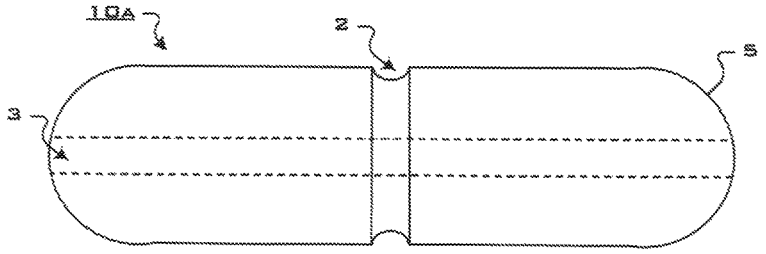
FIG. 5 is an elevation view of a second embodiment of a resilient exercise article.
Figure 6:
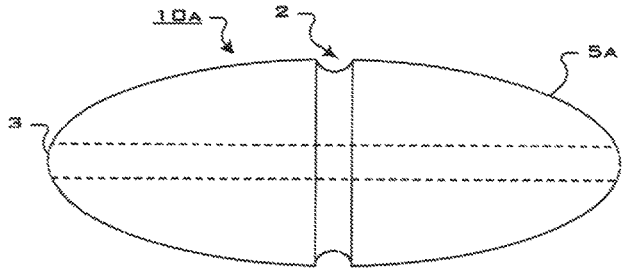
FIG. 6 depicts variation of an ovoid shaped article similar to the article shown in FIG. 5.
Figure 7:
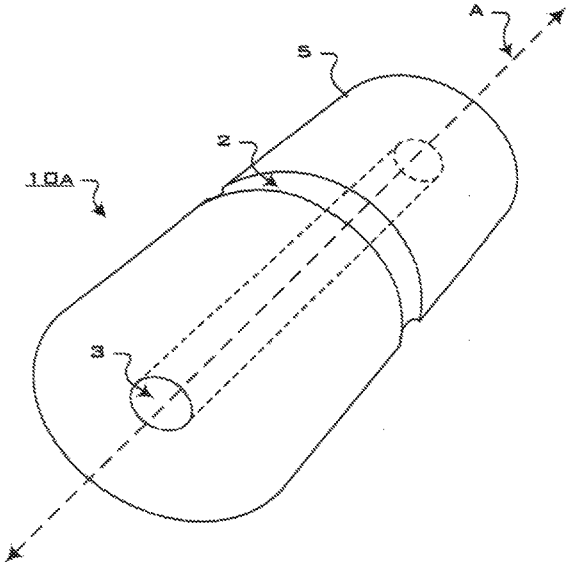
FIG. 7 is a perspective view of the article shown in FIG. 5.

An alternative embodiment is illustrated in FIGS. 5 through 7, wherein exercise article 10*a* comprises an ovoid 5, 5*a*. In this embodiment, the bore 3 extends through the article 10*a* coaxially with the article's 10*a* longitudinal axis A. A single circumferential channel 2 is defined in the surface of the article 10*a* disposed generally midway between either end of the ovoid 5, 5*a*.

Figure 8:
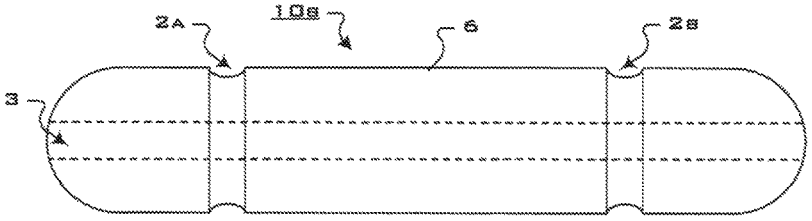
FIGS. 8-10 illustrate an ovoid-shaped resilient exercise article having two circumferential channels.
Figure 9:
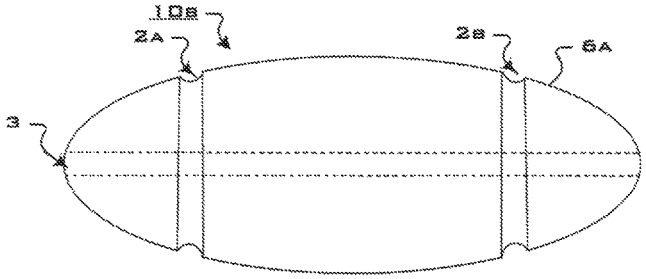
Figure 10:
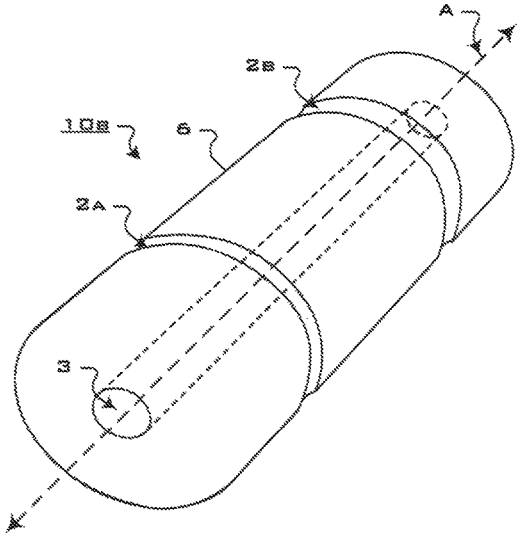
Figure 11:
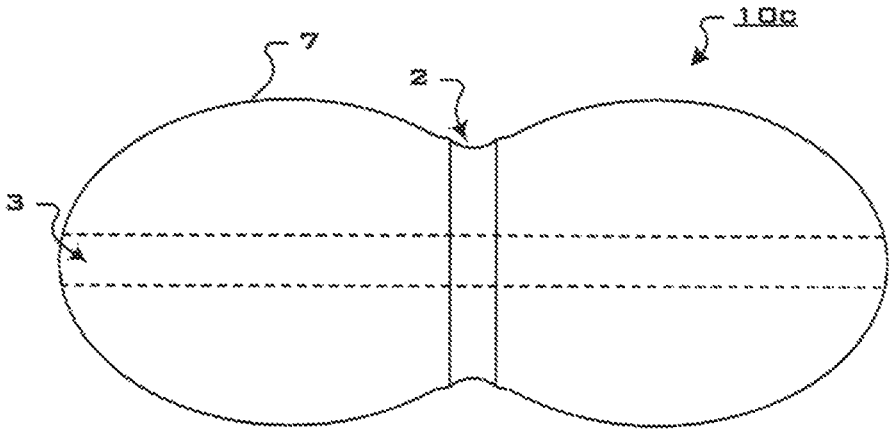
FIG. 11 is an elevation view of a double-ovoid version of a resilient exercise article.
Figure 12:
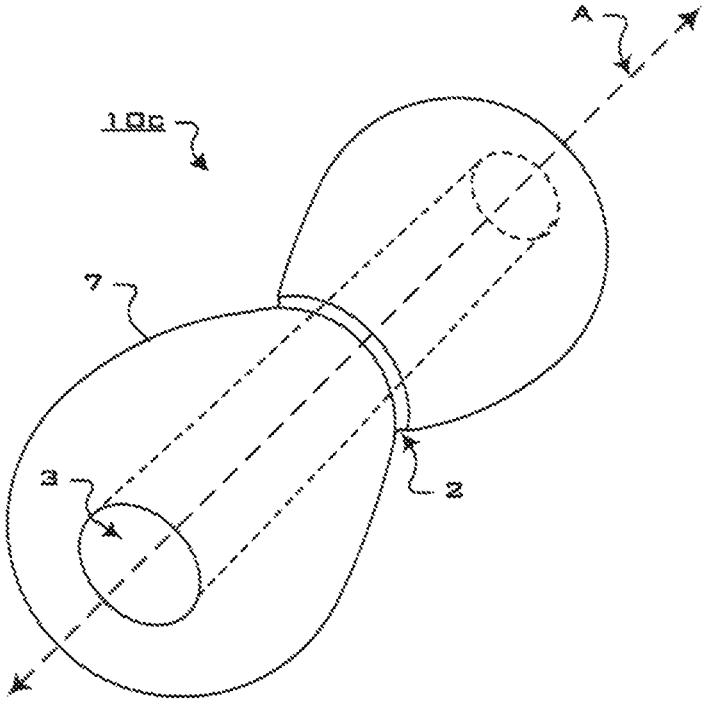
FIG. 12 is a perspective view of the article shown in FIG. 11.
Figure 13:
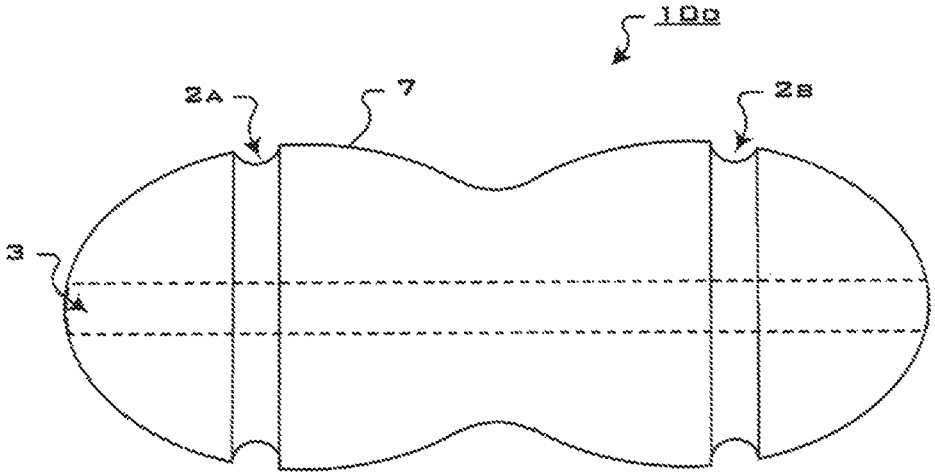
FIG. 13 is an elevation view of a double-ovoid embodiment of a resilient exercise article having two circumferential channels.

FIGS. 8 through 10 depict a further embodiment comprising a generally ovoid-shaped article 6, 6*a* having two circumferential grooves 2*a*, 2*b* defined in the surface of the article 10*b* proximal to either end. FIGS. 11 & 12 show a further embodiment in which the article 10*c* comprises a double ovoid 7 or "peanut shape". As shown, a single circumferential channel 2 is defined in the surface of the article 10*c* disposed roughly at the midpoint between either end. A variation of this embodiment is shown in FIG. 13 where the article 10*d* comprises a double ovoid shape 7 with two circumferential channels 2*a*, 2*b* defined in the surface of the article 10*d* disposed near either end of the article 10*d*.

As described above and shown in the associated drawings, the present invention comprises a resilient exercise article. While particular embodiments have been described, it will be understood, however, that any invention appertaining to the apparatus described is not limited thereto, since modifications may be made by those skilled in the art, particularly in light of the foregoing teachings. It is, therefore, contemplated by the appended claims to cover any such modifications that incorporate those features or those improvements that embody the spirit and scope of the invention.

What is claimed is:

1. A resilient exercise article comprising:

an outer surface defining an interior chamber, said outer surface being one of a spherical shape, an ovoid shape and a double ovoid shape;

at least one circumferential channel defined in said outer surface, wherein said at least one circumferential channel is recessed into an entire circumference of said outer surface, and wherein said at least one circumferential channel is configured to removably receive one of a band and a strap therein; and a bore extending axially through said resilient exercise; wherein said bore is configured to removably receive the one of the band or strap therein.

2. The resilient exercise article of claim 1, wherein said resilient exercise article is inflatable.

3. The resilient exercise article of claim 2, wherein said outer surface is one of the ovoid shape and the double ovoid shape, said resilient exercise article further comprising:

first and second ends; and the at least one circumferential channel comprising first and second circumferential channels defined in said outer surface disposed near each said first and second ends, respectively.

4. The resilient exercise article of claim 1, wherein said interior chamber houses a filling material.

5. The resilient exercise article of claim 4, wherein said outer surface is one of the ovoid shape and the double ovoid shape, said resilient exercise article further comprising:

first and second ends; and the at least one circumferential channel comprising first and second circumferential channels defined in said outer surface disposed near each said first and second ends, respectively.

6. The resilient exercise article of claim 1, wherein said outer surface is one of the ovoid shape and the double ovoid shape, said resilient exercise article further comprising:

first and second ends; and the at least one circumferential channel comprising first and second circumferential channels defined in said outer surface disposed near each said first and second ends, respectively.

* * * * *